United States Patent [19]

Legendre

[11] 4,016,682

[45] Apr. 12, 1977

[54] COPYING MACHINE NOTABLY FOR GRINDING CONCAVE SURFACES

[75] Inventor: Serge Legendre, Epinay sur Seine, France

[73] Assignee: Essilor International (Compagnie Generale d'Optique), Joinville le Pont, France

[22] Filed: June 10, 1975

[21] Appl. No.: 585,561

[30] Foreign Application Priority Data

June 20, 1974 France ..... 74.21438

[52] U.S. Cl. ..... 51/50 PC; 51/101 LG; 90/13.3

[51] Int. Cl.[2] ..... B24B 13/00; B24B 17/02

[58] Field of Search ..... 51/50 PC, 101 LG, 101 R, 51/DIG. 14; 90/13.3, 13.4

[56] References Cited

UNITED STATES PATENTS

| | | | |
|---|---|---|---|
| 765,268 | 7/1904 | Bishop | 51/50 PC |
| 1,478,334 | 12/1923 | Grefe | 90/13.4 |
| 3,041,789 | 7/1962 | Cretin-Maitenaz | 51/101 R |

FOREIGN PATENTS OR APPLICATIONS

| | | | |
|---|---|---|---|
| 132,966 | 11/1960 | U.S.S.R. | 51/101 R |

*Primary Examiner*—Gary L. Smith

[57] ABSTRACT

Grinding machine of the copying type for grinding a concave surface of an article such as a lens blank, comprising a templet having a concave surface identical with that to be obtained on the article and with a mean sphere. The machine also comprises a pair of supports for the templet and the article, respectively, which are both rotatably driven in synchronism about two parallel axes, a movable copying head carrying a pin-point contact feeler engageable with the templet and a rotatably driven grinding wheel, and means for guiding the copying head so as to impart thereto a component of movement of rotation about fixed axis passing through the center of the mean sphere of the concave surface of the templet. This axis is parallel to a straight line passing through the centers of symmetry of the feeler and grinding wheel, while the distance between said straight line and the fixed axis is variable.

5 Claims, 4 Drawing Figures

COPYING MACHINE NOTABLY FOR GRINDING CONCAVE SURFACES

BACKGROUND OF THE INVENTION

1. Field of the Invention

The present invention relates to copying machines, notably of the type permitting obtaining a concave surface on an article such as a lens blank, and has specific reference to a grinding machine operating according to the copying principle for making concave surfaces of ophtalmic lenses.

2. Description of the Prior Art

Grinding machines are already known which operate according to the copying principle and permit grinding the concave surfaces of ophthalmic lenses, especially the aspheric convex surfaces of ophthalmic lenses of the type wherein the surface curvature varies continuously from one edge to the opposite edge of the lens in order to impart thereto a focal power varying as the axis of vision scans the lens, for instance from the upper edge to the lower edge thereof. For instance such lenses, usually referred to as variable focal power lenses, are known in the trade under the name of "Varilux". Known grinding machines designed for obtaining these non-spherical surfaces comprise as a rule a working table, an interchangeable templet having a convex surface corresponding to the surface to be made on a lens blank, a pair of supports for the templet and for the lens blank respectively, which are rotatably mounted side by side on the table and driven for synchronous rotation about two parallel axes merging into the templet axis and the optical axis of the blank on which the desired convex surface is to be made, respectively, and a movable copying head carrying a feeler for making a pin-point contact with the templet, and a rotatably driven grinding wheel. In grinding machines of this type both the grinding wheel and the feeler have a cylindrical shape and have the same radius. The copying head is pivotally mounted by means of a generally horizontal shaft, or pair of trunnions, on a carriage movable in a direction perpendicular to the plane defined by the generally vertical axes of rotation of said pair of supports. With this arrangement, the feeler and the grinding wheel bear by gravity on the templet and the lens blank, respectively, and since the latter are rotatably driven together with their respective supports, the feeler and grinding wheel describe each a spiral path respectively on the templet and on the lens blank when the carriage is moved, thus reproducing the entire convex surface of said templet.

Although known grinding machines of the above-described type are very satisfactory for making convex aspheric surfaces, they are not suited for obtaining concave surfaces. This is due to two reasons, the first one being that it is not possible to obtain a pin-point contact between a cylindrical feeler and a templet having a concave surface. A first modification is therefore necessary, namely, the use of a feeler and of a grinding wheel having both a convex surface of revolution, for example a sperical or toroidal grinding wheel. Moreover, the feeler and grinding wheel should have a radius of curvature smaller than the smallest radius of curvature of the concave surface of the templet. However, even if these modifications were adopted and if the above-mentioned requirements were met, hitherto known grinding machines thus modified would nevertheless still not operate satisfactorily for grinding concave surfaces for various reasons which will now be explained with reference to FIG. 1 of the attached drawings, illustrating diagrammatically by way of example a known grinding machine equipped with a sperical grinding wheel and used for grinding a concave surface.

In this FIG. 1 the reference numeral 1 designates a lens blank on the top surface of which a concave surface S is to be obtained. A support 2 for the blank 1 is rotatably driven about a vertical axis, and a grinding wheel, for example a spherical wheel, is mounted to one end of a rotatably driven spindle 4 mounted for rotation in a copying head shown diagrammatically in the form of an arm 5. This arm 5 is pivotally mounted on a carriage 6 adapted to travel horizontally, i.e. at right angles to the axis of rotation of support 2. To facilitate the understanding it will be assumed firstly in the following disclosure that the concave surface S to be obtained is a portion of a sphere centered to the optical axis of blank 1. It will be seen that when the grinding wheel 3 is substantially located centrally of blank 1, it bears there against in a direction substantially perpendicular to the concave surface of the blank. On the other hand, when the grinding wheel 3 is on the marginal portion of blank 1, after the carriage 6 has been moved from the position shown in thick lines to the positions shown in dash and dot lines in FIG. 1, the wheel 3 bears against the blank 1 in a direction which is no longer perpendicular to the concave surface of this blank. As a result, there is a risk of chipping, spalling or flaking the marginal portion of the glass blank 1 as a consequence of the force applied by the grinding wheel on the blank.

The smaller the radius of curvature of surface S, the higher the risk of spalling the edge of the glass blank.

Moreover, it will be seen that when the grinding wheel 3 is located substantially centrally of the blank 1, it is the small spherical zone **3*a* of wheel 3 that removes material from the blank 1, whereas when the wheel 3 is grinding the area near or at the edge of the blank 1, the glass is ground by the small spherical zone 3*b* of the wheel. In other words, when the carriage 6 is moved from the position shown in thick lines to the position shown in dash and dot lines of FIG. 1, the working or useful spherical area of wheel 3 is shifted from zone 3*a* to zone 3*b*. Therefore, the wheel 3 is worn on a relatively wide spherical surface area bounded by small zones 3*a* and 3*b*. Since the direction in which the wheel 3 is pressed against the blank 1 varies as the wheel 3 moves from the centre to the edges the blank, the degree of wear of the grinding wheel 3 is not the same or uniform throughout the width of the working area defined by said small zones 3*a* and 3*b***. Consequently, it is not possible to compensate wear as in the case of a working area (as seen on the grinding wheel itself) remaining constantly the same. With such a known grinding machine, it is clear that concave surfaces cannot be obtained with a sufficient degree of fidelity, unless the grinding wheel is replaced very frequently.

It is obvious that the above-described known grinding machine has the same drawbacks, possibly amplified, when the concave surface S of blank 1 is a toroidal or aspheric surface, for example the aspherical surface of a Varilux type ophthalmic lens. Moreover, in case the surface S were a toroidal or aspheric surface, the working area of the grinding wheel, when the latter is in any intermediate position between the two positions illustrated in FIG. 1, is not the same for all the possible angular positions of support 2 and blank 1, because the radius of curvature of the concave surface S has not the same value for all the sections of blank 1 taken through planes containing the optical axis. Assuming that the carriage 6 remains stationary, the distance between the centre 0 of surface S and the point of contact between the grinding wheel 3 and the surface S will thus vary during one revolution of support 2. Consequently, when the support 2 rotates and the carriage 6 is moved slowly, the point of contact between the grinding wheel 3 and the surface S describes on the latter a spiral having a variable pitch. Therefore, the surface S is not ground regularly. Moreover, when the surface S is of toroidal configuration with its two main radii having different values, the spiral thus described is elongated considerably in one direction and somwhat flattened in the direction perpendicular to said one direction, thus requiring the use of a templet which, when seen in plane view, has an elongated configuration.

For all the reasons set forth hereinabove, it is not desirable to use the known grinding machines operating according to the copying principle, even if a spherical or toroidal grinding wheel is adapted thereto, for obtaining concave surfaces.

SUMMARY OF THE INVENTION

It is therefore the essential object of the present invention to provide a grinding machine of the copying type for obtaining a concave surface on an article such as a lens blank, wherein all risks of spalling the edge of the lens blank is substantially eliminated.

It is another object of the present invention to provide a grinding machine of the copying type, wherein the operative area of the grinding wheel is reduced to a relatively small area which remains substantially the same throughout the grinding operation, so that the wear to which the wheel is subjected can easily be compensated.

It is a further object of the present invention to provide a grinding machine of the copying type, wherein the point of contact between the grinding wheel and the surface of the lens blank describes a regular spiral on the concave surface of the lens blank, so that said concave surface is ground very regularly and uniformly.

For this purpose, the invention provides a grinding machine of the copying type for making a concave surface on an article such as a lens blank, comprising a working table, an interchangeable templet having a concave surface identical with the concave surface to be obtained, said concave surface comprising a means sphere centered to an axis substantially perpendicular to the concave surface centrally of said concave surface, a pair of supports for said templet and said article, respectively, mounted side by side on the working table and driven for synchronous rotation about two parallel axes, the axis of rotation of the templet support being coincident with the axis of said concave surface, a movable copying head carrying, a feeler carried by said copying head and shaped to be able to make a pin point contact with the concave surface of the templet, a rotatably driven grinding wheel carried by said copying head, said feeler and grinding wheel having identical convex curved working surfaces having a centre of symmetry, said copying head being movable between a first position in which the centres of symmetry of said feeler and grinding wheel are located on the axes of rotation of said supports respectively, and a second position in which said centres of symmetry are spaced from the axes of rotation of said supports, and guide means for imparting to said movable copying head, as it moves from said first position to said second position, a component of movement of rotation about an axis passing substantially through the centre of said mean sphere of the templet concave surface, said axis being parallel to a straight line passing through the two centres of symmetry of said feeler and grinding wheel, the distance between said straight line and said axis being variable.

In the following disclosure and in the attached Claims the term "mean sphere of the concave surface" means a sphere centered to the axis of the concave surface (i.e. the official axis in the case of an ophthalmic lens), and having a radius of a value substantially equal to the mean value of the radii of curvature of the desired concave surface. Of course, when the concave surface is a portion of a sphere, the mean sphere of this concave surface is merged into the concave surface proper.

In a specific embodiment of this invention the copying head may be connected to a carriage movable in a direction perpendicular to the plane containing the axes of rotation of both supports. Under these circumstances, the copying head may be connected to the carriage by means of an arm having one end pivotally connected to the carriage and the opposite end pivoted to the copying head, through two pivot axes parallel to each other, respectively, and also to the axis of rotation of the copying head. Moreover, the guide means may comprise in this case a cam carried by the working table and coacting with a cam follower carried by the arm connecting the copying head to the carriage, the cam contour being so designed that when the carriage is moved from said first position to said second position and the roller engages said cam contour, the pivot axis connecting the copying head to the arm rotates about the axis of rotation of the copying head, the last-mentioned axis being then virtual and stationary.

Now a detailed description of the present invention will be given with reference to the attached drawing, in which:

DESCRIPTION OF THE PREFERRED EMBODIMENT

Figures 1, 2:
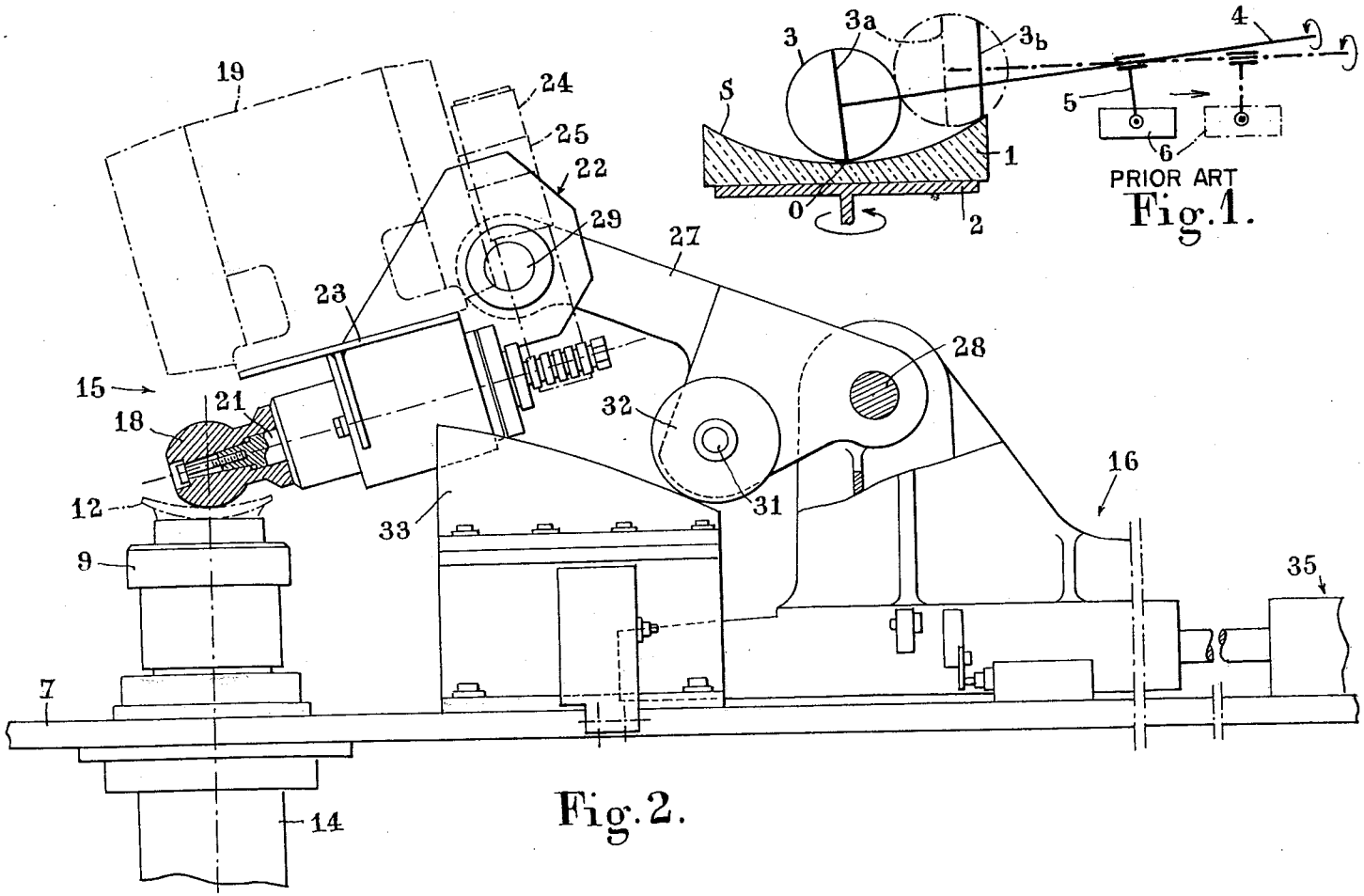
PRIOR ART Fig. 1.
FIG. 1 illustrates very diagrammatically, as already mentioned in the foregoing, a typical and known grinding machine equipped with a spherical grinding wheel, when it is used for attempting to obtain a concave spherical surface.
FIGS. 2 and 3 are side and front elevational views, respectively, showing the essential component elements of a grinding machine according to a typical embodiment of this invention.
Figure 3:
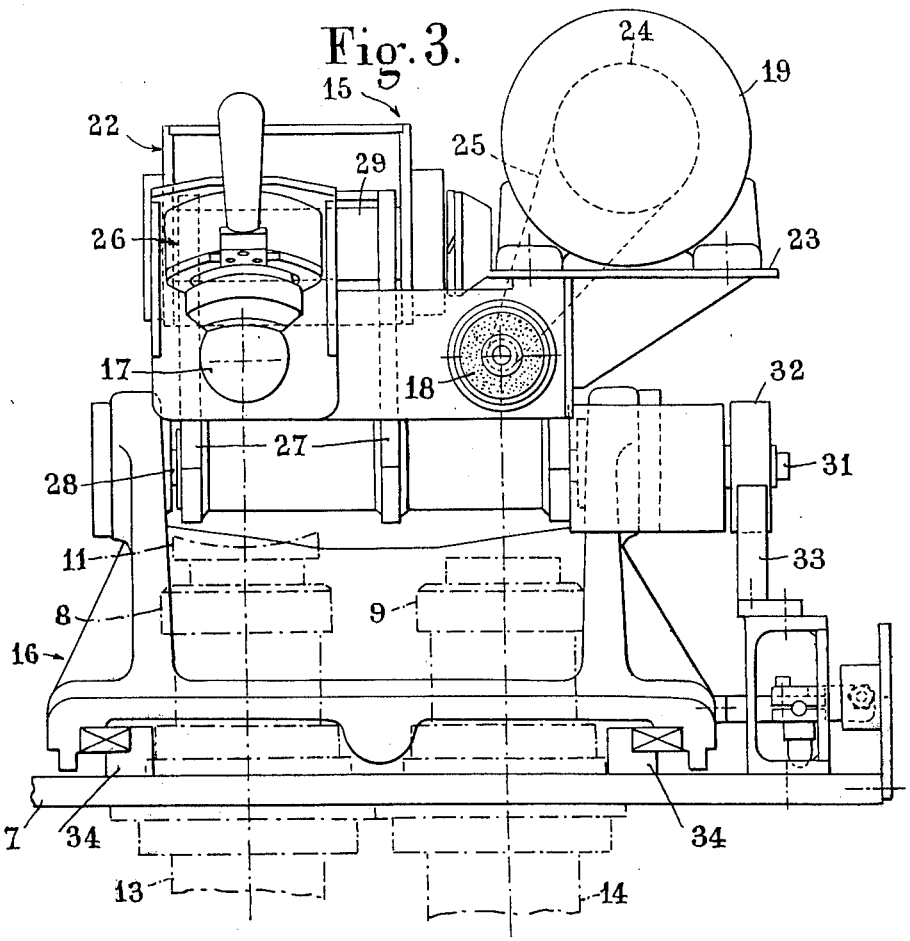

The grinding machine illustrated in FIGS. 2 and 3 comprises in a manner known per se a horizontal working table 7 supported by a frame structure (not shown) and a pair of supports 8 and 9 for a templet 11 and a lens blank 12, respectively, said templet 11 having a concave top surface identical with the desired surface to be reproduced on the top surface of the lens blank 12. Both supports 8 and 9 are secured to the upper ends of a pair of vertical shafts 13 and 14, respectively, rotatably mounted side by side and in paralles relationship in working table 7, these shafts 13 and 14 being adapted to be rotatably driven synchronously and in the same direction (for example for obtaining an ophthalmic lens for the right eye) or in opposite directions (for example for obtaining an ophthalmic lens for the left eye), by driving means (not shown). The templet 11 and lens blank 12 are detachably mounted on supports 8 and 9, respectively, so that they can be rotatably driven thereby, through blocking means known per se and therefore not described herein since they are well known to those conversant with the art. The optical axis of the concave surface of templet 11 and the optical axis of the lens blank 12 are coincident with the rotational axes of supports 8 and 9, respectively, i.e. with the axes of shafts 13 and 14.

The grinding machine illustrated in FIGS. 2 and 3 further comprises a copying head 15 connected to a carriage 16 movable in a direction at right angles to the plane defined by the axes of rotation of supports 8 and 9.

The copying head 15 carries in a manner known per se a feeler 17 shaped to engage by pin-point contact the templet 11 and a grinding wheel 18 rotatably driven by a motor 19, for example an electric motor. The feeler 17 and grinding wheel 18 have identical curved convex working surfaces having a centre of symmetry. In the example illustrated, the feeler 17 and grinding wheel 18 have a spherical configuration, but it is clear that they could have a toroidal configuration or any other shape of revolution having a convex generatrix. However, in all cases and in order to obtain under all circumstances a pin-point contact between the feeler 17 and templet 11, the largest radius of curvature of the feeler and grinding wheel must be smaller than the smallest radius of curvature of the concave surface of the templet or templets utilized with the machine.

The grinding wheel 18 is detachably mounted to one end of a spindle 21 mounted for rotation in an auxiliary frame structure 22. The motor 19 is secured to a bracket 23 constituting a part of said frame structure 22, and the torque of motor 19 is transmitted to the spindle 21 through a pulley 24 keyed to the output shaft of said motor and through a transmission belt 25.

Furthermore, means (not shown) are provided on said auxiliary frame structure 22 for moving the spindle 21 and grinding wheel 18 in two horizontal directions at right angles to each other so that when the copying head 15 is in the position shown in FIG. 2 the centre of symmetry of grinding wheel 18 can be brought to a position in which said centre lies on the vertical axis of rotation of support 9, in other words on the optical axis of the lens blank 12.

The feeler 17 is also mounted to frame structure 22 by means of means 26 operative to allow adjustment of the position of said feeler and to block the latter in the desired position, i.e. in a position such that the centre of symmetry of the feeler lies on the axis of rotation of support 8 when the copying head is in the position illustrated in FIG. 2. Said means 26 may consist for example of a ball-and-socket joint associated with clamping means whereby the ball-and-socket joint can be blocked in the desired position.

According to a specific feature of the present invention, instead of being connected directly to the carriage 16 as in known grinding machines, the auxiliary frame structure 22 of copying head 15 is connected to carriage 16 by means of a pivoted arm 27. This arm has one end pivotally mounted to the carriage 16 by means of a pivot axis 28, and its opposite end pivoted to the auxiliary frame structure 22 by means of another pivot axis 29. A pivot axis 31 extends laterally from one side of the arm 27 and is parallel to the pivot axes 28 and 29; pivot axis 31 carries a roller 32. When the carriage 16 travels in a direction at right angles to the axes of rotation of supports 8 and 9, the roller 32 engages a cam 33 detachably mounted to the working table 7. As shown more particularly in FIG. 3, the movements of carriage 16 are guided by a ball race 34 secured to the working table 7. The carriage 16 may be driven for instance by a double acting cylinder and piston actuator 35 having its piston rod operatively connected to the carriage 16. Alternatively, it may be driven by an electric motor of the reversing type (i.e. adapted to rotate in either direction) driving a worm meshing in turn with a nut carried by carriage 16.

In FIG. 3 the copying head 15 is shown in its raised position. This position, which permits the fitting of a new blank 12 on the support 9 before performing a grinding operation, and the removal of the ground lens blank upon completion of the grinding operation may be obtained by using a hydraulic cylinder and piston actuator (not shown) carried for example by the arm 27, the piston rod of this actuator being connected for example to the auxiliary frame structure 22 so as to cause the frame structure 22 to pivot about the pivot axis 29 when the actuator is supplied with a fluid by distributor means (not shown).

Figure 4:
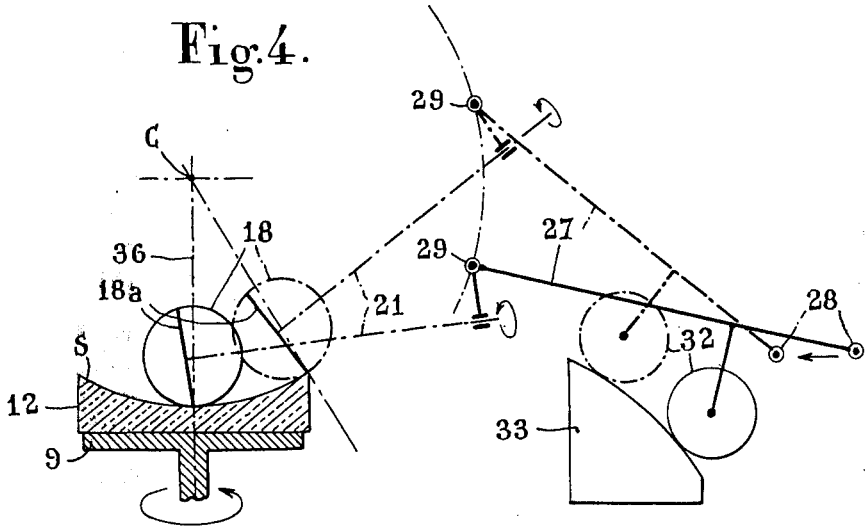
FIG. 4 is a diagrammatic view illustrating the mode of operation of the grinding machine illustrated in FIGS. 2 and 3.

Now the mode of operation of the above-described grinding machine will be described with reference to FIG. 4 of the drawing. Firstly, in order to simplify the disclosure it will be assumed that the concave surface to be obtained is a spherical surface having a center C lying on the optical axis 36 of lens blank 12, which is also the axis of rotation of support 9. In this case, the cam contour of cam 33 is so designed that when the roller 32 engages cam 33, axis 29 will rotate about the centre C or more exactly will generate a portion of a cylinder having its axis perpendicular at C to the plane of FIG. 4, i.e. parallel to the straight line interconnecting the two centres of symmetry of feeler 17 and grinding wheel 18. Thus, when the carriage 16 is moved from right to left as shown by the arrow in FIG. 4 and the roller 32 rolls on cam 33 from the position shown in thick lines to the position shown in dash and dot lines, the copying head supporting the grinding wheel 18 and the spindle 21 moves from a first position in which the centre of symmetry of the grinding wheel 18 lies on the optical axis 36 of lens blank 12, to a second position in which said centre of symmetry is spaced from optical axis 36. Similarly, during this movement of the copying head, the centre of symmetry of feeler 17 (FIG. 3) moves from a position in which it lies on the axis of rotation of support 8 to another position in which it is spaced from this axis. It will be seen that the movement of the copying head and therefore also that of grinding wheel 18 may be divided into two movements of rotation, namely a first movement about the pivot axis 29 which enables the grinding wheel 18 to engage by gravity the lens blank 12, and a second movement about the aforesaid fixed axis passing through the centre C of the concave surface S and parallel to the line joining the centres of symmetry of feeler 17 and grinding wheel 18. This second component of the rotational movement is determined by the arm 27, roller 32 and cam 33. Of course, in addition to the above two movements of rotation the grinding wheel 18 accomplishes a third relatively fast movement of rotation about the axis of the spindle 21. As clearly apparent from FIG. 4, without respect to the position assumed by the copying head and therefore by the grinding wheel 18 in relation to the lens blank 12, the useful area 18*a* of grinding wheel 18, i.e. the area actually used for grinding the lens blank 12, remains always the same during the movement of the copying head, thus avoiding the above-mentioned inconveniences. Moreover, since during its displacement the grinding wheel 18 has a component of rotation about the point C, any risk of spalling or chipping the edge of the lens blank 12 is definitely or at least substantially avoided.

Although the above-described grinding machine could be used for obtaining spherical concave surfaces according to the copying method, such spherical concave surfaces may be generated in a very simple manner by other known methods. Therefore the grinding machine of the invention is intended more particularly for obtaining by copying spheric surfaces such as toroidal surfaces or other aspheric surfaces of the type necessary for making lenses having a progressively varying focal power. In the case of such last-mentioned concave toroidal or aspheric surfaces, it is possible to define a mean sphere, i.e. sphere centered to the optical axis of the surface and having a radius equal to the mean value of the radii of curvature of the toroidal or aspheric surface. Under these circumstances, the contour of cam 33 is designed in each case in such a manner that the second component of the rotational movement of the copying head is a movement about an axis passing through the centre of the mean sphere of the concave surface to be obtained, therefore also the centre of the mean sphere of the templet concave surface. In other words, in this case the point C of FIG. 4 is the centre of the mean sphere. It is thus possible to obtain with a sufficient and satisfactory approximation the same advantageous results as those obtainable when the surface S to be ground is spherical. Of course as already pointed out hereinabove the templet 11 and cam 33 are interchangeable so that other templet 11 and cams 33 can be substituted therefor to permit the grinding of another type of concave surface or another family of concave surfaces.

In the preceding description the fixed axis about which the copying head is adapted to rotate under the influence of the guide means consisting of arm 27, roller 32 and cam 33, is a virtual axis and the distance between this virtual axis and the straight line interconnecting the centres of symmetry of feeler 17 and grinding wheel 18 may vary since the copying head is also pivoted to the arm 27 by means of pivot axis 29. However, in a modified embodiment of the invention the fixed axis passing through the centre of the mean sphere of the concave surface may consist of a shaft supported in a suitable manner in relation to the working table 7. Moreover, in the foregoing the grinding machine described was intended more particularly for making concave surfaces on lens blanks. However, it will readily occur to those conversant with the art that the present invention is also applicable to the making of concave surfaces on other articles such as moulds or shapes intended for producing convex surfaces of ophthalmic lenses by moulding a polymeric organic substance or a substance adapted to yield or soften under the action of heat. By utilizing a suitable cam contour the present invention also permits of grinding convex surfaces.

I claim:

1. A grinding machine of the copying type for making a concave surface on an article, comprising a working table, an interchangeable templet having a concave surface identical with the concave surface to be obtained, said concave surface having associated therewith a mean sphere centered to an axis substantially perpendicular to the concave surface centrally of said concave surface and having a radius of a value substantially equal to the mean value of the radii of curvature of the desired concave surface, a pair of supports for said templet and said article, respectively, mounted side by side on the working table and driven for synchronous rotation about two parallel axes, the axis of rotation of the templet support being coincident with the axis of said concave surface, a movable copying head, a feeler carried by said copying head and shaped to be able to make a pin point contact with the concave surface of the templet, a rotatably driven grinding wheel carried by said copying head, said feeler and grinding wheel having identical convex curved working surfaces each having a centre of symmetry, the two centres of symmetry defining a straight line extending at right angles to the axes of rotation of said templet and article supports, said copying head being movable between a first position in which the centres of symmetry of said feeler and grinding wheel are located on the axes of rotation of said templet and article supports respectively, and a second position in which said centres of symmetry are spaced from the axes of rotation of said templet and article supports, and guide means for imparting to said movable copying head, as it moves from said first position to said second position, a component of movement of rotation about a fixed axis passing substantially through the centre of said mean sphere of the templet concave surface, said fixed axis being parallel to said straight line defined by the two centres of symmetry of said feeler and grinding wheel, the distance between said straight line and said fixed axis being variable.

2. Grinding machine according to claim 1, comprising a carriage movable in a direction perpendicular to the plane defined by the axes of rotation of the two supports, wherein the copying head is connected to the carriage by means of an arm pivotally connected at one end to the carriage and at the opposite end to said copying head, respectively, by means of a pair of axes parallel to each other and to said fixed axis passing through the centre of said mean sphere.

3. Grinding machine according to claim 2, wherein said guide means comprise a cam adapted to co-operate with a cam follower carried by the arm connecting said copying head to said carriage, said cam having a contour which is so shaped that, when said carriage is moved and the cam follower engages the cam contour, the axis connecting said copying head to said arm rotates about said fixed axis passing through the centre of said mean sphere, said fixed axis being virtual.

4. Grinding machine according to claim 3, wherein said cam is detachably secured to said working table so as to be interchangeable.

5. Grinding machine according to claim 3, wherein both the feeler and the grinding wheel have a spherical configuration with a radius smaller than the smallest radius of curvature of the concave surface of said templet.

* * * * *